US008910832B2

(12) United States Patent
Nobbio

(10) Patent No.: US 8,910,832 B2
(45) Date of Patent: Dec. 16, 2014

(54) DEVICE FOR THE PRESERVATION OF SUBSTANCES TO BE KEPT SEPARATE UNTIL THEIR APPLICATION

(71) Applicant: Inge SpA, Garbagnate Milamese (IT)

(72) Inventor: Alessio Nobbio, Milan (IT)

(73) Assignee: Inge S.p.A., Garbagnate Milanese (MI) (IT)

( * ) Notice: Subject to any disclaimer, the term of this patent is extended or adjusted under 35 U.S.C. 154(b) by 0 days.

(21) Appl. No.: 13/750,910

(22) Filed: Jan. 25, 2013

(65) Prior Publication Data

US 2013/0228481 A1 Sep. 5, 2013

(30) Foreign Application Priority Data

Jan. 25, 2012 (IT) ..... TO2012A0060

(51) Int. Cl.

| | |
|---|---|
| ***B67D 7/74*** | (2010.01) |
| ***B65D 81/32*** | (2006.01) |
| ***B65D 25/08*** | (2006.01) |

(52) U.S. Cl.

CPC ..... *B65D 81/3261* (2013.01); *B65D 25/082* (2013.01)

USPC ..... 222/129; 222/145.5; 222/215; 222/80; 222/541.1; 206/219; 215/227; 220/578; 604/91; 604/416

(58) Field of Classification Search

CPC ..... B67D 7/74; B67D 7/78; B65D 37/00; B65D 25/08; B65D 25/10; A61M 37/00

USPC ..... 206/219–222; 215/DIG. 8, 227, 317; 220/578; 604/37, 87–92, 416; 222/129, 222/145.5–145.6, 215, 80–91, 541.1

See application file for complete search history.

(56) References Cited

U.S. PATENT DOCUMENTS

| | | | | |
|---|---|---|---|---|
| 3,354,883 | A * | 11/1967 | Southerland | 604/88 |
| 5,383,579 | A * | 1/1995 | Lanfranconi et al. | 222/129 |
| 5,542,528 | A * | 8/1996 | Lanfranconi et al. | 206/221 |
| 6,758,374 | B2 | 7/2004 | Albiesetti | |
| 7,789,854 | B2 * | 9/2010 | Talamonti | 604/90 |
| 2010/0197542 | A1 * | 8/2010 | Talamonti | 510/119 |

FOREIGN PATENT DOCUMENTS

| | | |
|---|---|---|
| EP | 0 356 841 | 4/1993 |
| EP | 0 823 996 | 2/1998 |
| EP | 1 174 190 | 1/2002 |
| EP | 2 135 820 | 12/2009 |
| IT | 1251658 | 5/1995 |
| WO | WO 2005/112634 | 12/2005 |

OTHER PUBLICATIONS

Italian Search Report for IT TO20120060 mailed Jun. 14, 2012 (7 pages).

* cited by examiner

*Primary Examiner* — Paul R Durand
*Assistant Examiner* — Andrew P Bainbridge
(74) *Attorney, Agent, or Firm* — Merchant & Gould P.C.

(57) ABSTRACT

Device for the preservation of substances to be kept separate until their application includes a container (2), which is provided with an at least partially deformable body (6), and a delivery mouth (4), on which there is provided a delivery element for delivering the mixture. A watertight chamber (5) is arranged between the delivery mouth and the body of the container and is provided with a connection mouth (12) for the connection to the body (6), which is closed by cap means (20). A component of the substance to be delivered is contained in the watertight chamber (5), whereas another component is contained in the body (6). The communication between the two components is established by removing said cap, by interference between the walls of the cap and the walls of the body.

4 Claims, 2 Drawing Sheets

DEVICE FOR THE PRESERVATION OF SUBSTANCES TO BE KEPT SEPARATE UNTIL THEIR APPLICATION

This application claims benefit of Serial No. TO2012A000060, filed 25 Jan. 2012 in Italy and which application is incorporated herein by reference. To the extent appropriate, a claim of priority is made to each of the above disclosed applications.

BACKGROUND OF THE INVENTION

The present invention is related to a device for dispensing substances, for example liquid substances, to be kept separate until their application. Devices or bottles are known, which comprise two containers, generally with different capacities, and in which one container is filled with some of the components of the solution, while the other container is filled with the other components of the solution. Upon application of the product, a communication is established between the two containers, thus allowing the components to be mixed.

The Italian patent no. IT1251658, in the name of the same Applicant, discloses a device of the type described above and comprising a container 2, which is provided with a body 6, which is at least partially deformable, and with a delivery mouth, on which there is provided at least one mixture delivery element. A watertight chamber is arranged between said delivery mouth and said body of the container and is provided with a connection mouth for the connection to the body of the container, which is closed by cap means that can be removed.

A component of said mixture is contained in said watertight chamber, whereas another component is contained in the deformable body. The communication between the two components is established by removing said cap means, said removal occurring by interference between the walls of said cap means and the walls of the body of the container.

The device comprises a bellows portion, which has a horizontal annular wall, and an upper annular wall, which, in section, is oblique. Under the horizontal wall there are provided ribs. The cap means, in one of the two embodiments, can be removed by compressing the bellows and by causing the cap means to come in contact with an annular narrowing, which is arranged in the body under the bellows and has a diameter that is smaller than the diameter of the cap. In this way, the cap is removed from its mouth.

The effectiveness of this method for removing the cap substantially depends on the effectiveness of the bellows and on the dimensions of the annular narrowing.

SUMMARY OF THE INVENTION

The object of the present invention is to suggest an improvement of the device described above.

BRIEF DESCRIPTION OF THE DRAWINGS

The features and the advantages of the device according to the present invention will be best understood upon perusal of the following detailed description, which is explanatory and non-limiting, with reference to the accompanying drawings, which specifically illustrate what follows.

DETAILED DESCRIPTION OF THE PREFERRED EMBODIMENTS

Figure 3:
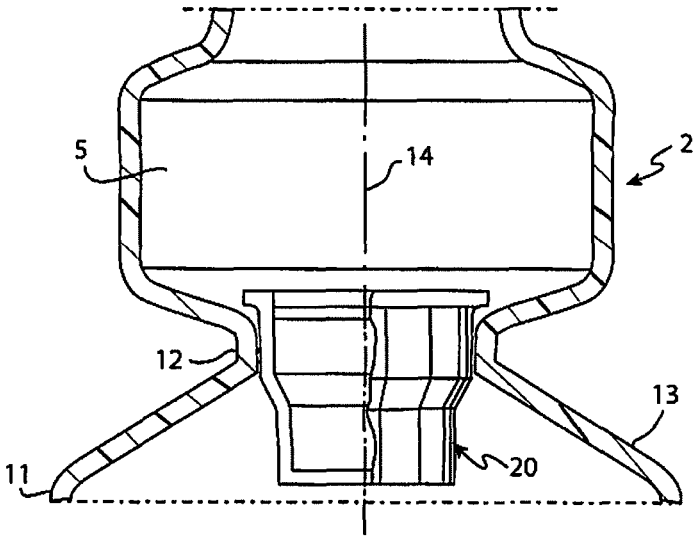
FIG. 3 shows an enlarged detail of the device of FIG. 1 in a cross-section view.
Figure 1:
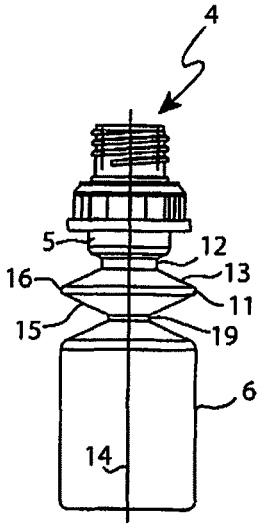
FIG. 1 shows a front view of the device.
Figure 2:
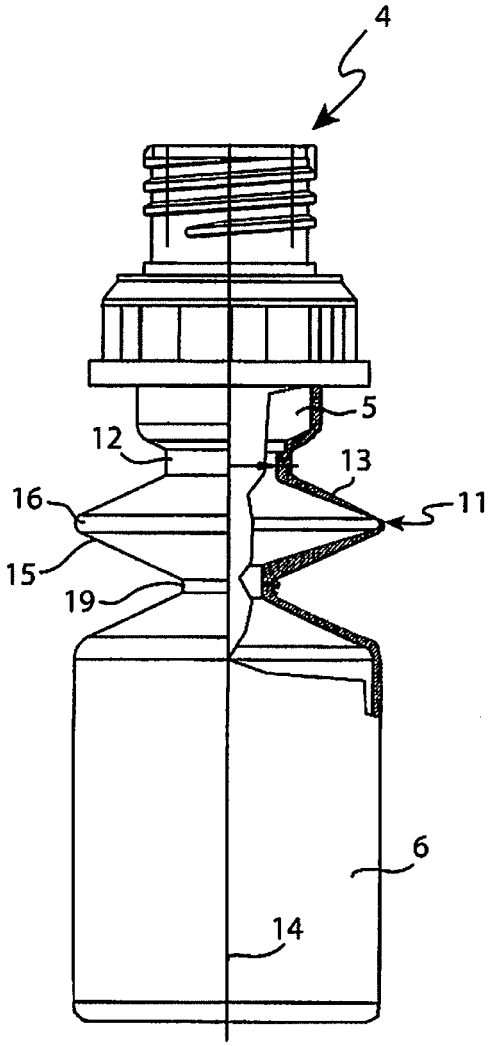
FIG. 2 shows the device of FIG. 1 in a front view and in a partial cross-section view.

With reference to the figures mentioned above, the device according to the present invention comprises a container 2, which is provided with an at least partially deformable body 6 and with a delivery mouth 4, on which there is provided a delivery element for delivering the mixture. A watertight chamber 5 is arranged between said delivery mouth and said body of the container and is provided with a connection mouth 12 for the connection to the body of the container, which is closed by cap means 20 that can be removed. A component of said mixture is contained in said watertight chamber, whereas another component is contained in the deformable body. The communication between the two components is established by removing said cap means, said removal occurring by interference between the walls of said cap means and the walls of the body of the container.

The device comprises a bellows portion 11 and cap means 20 can be removed by compressing the bellows itself and by causing cap means 20 to come in contact with an annular narrowing 19, which is arranged in the body under the bellows itself and has a diameter that is smaller than the diameter of the cap. In this way, the cap is removed from its mouth 12.

According to the present invention, the bellows portion comprises an upper annular wall, which is oblique with respect to vertical axis 14 of the device, and a lower annular wall 15, which is oblique as well. The two walls are connected to each other in correspondence to their outer circumferences by means of a thin portion 16, which is substantially cylindrical. This portion allows the bellows to be easily compressed.

According to a further feature of the present invention, annular narrowing 19 presents at least one first diameter with a smaller size than a second diameter thereof and said first diameter has a diameter that is smaller than cap 20. Preferably, said annular narrowing has an oval shape. In this way one can be sure of the fact that, when the bellows is compressed, the cap cannot move across the annular narrowing and maybe remain stuck therein, thus making the mixing of the two components contained in chamber 5 and in deformable body 6 very difficult.

In both cases, the removal of the cap means occurs when the container is still closed in a watertight manner by the manually removable appendage. Therefore, the container can be vigorously shaken without the risk of the solution flowing out if the container itself. Furthermore, it is even possible to properly mix components of solutions that are scarcely mixable with one another; in case the solution is particularly aggressive, it can be preserved in the container in a separate manner, so as to have, inside the container, components with a reduced chemical aggressiveness that can be kept separate for a long time, until the solution has to be used, without alterations of the solution and/or of the perforation of the container.

In particular, the watertight chamber usually contains the component that determines the disinfecting action of the solution and that is more delicate from the point of view of the preservation. A suitable component is povidone-iodine, whereas body 6 contains a conventional eyedrops product. The mixture between the disinfectant and the eyedrops is formed only upon application of the eye product itself, thus keeping the properties of the solution unchanged for a longer time.

The invention claimed is:

1. Device for the preservation of substances to be kept separate until their application comprising:

a container, which is provided with an at least partially deformable body, and a delivery mouth, on which there is provided a delivery element for delivering the mixture, a watertight chamber arranged between said delivery mouth and said body of the container and provided with a connection mouth for connection to the body, which is closed by a cap, a first component of said substance to be delivered being contained in said watertight chamber;

wherein a second component is contained in the body, communication between the first and second components being established by removing said cap, said cap being configured for removing by interference between walls of said cap and walls of said body of the container;

a bellows portion, which, when compressed, puts the cap in contact with an oval shaped annular narrowing, which is arranged in the body under the bellows, the oval shaped narrowing being configured to prevent the cap from moving across the annular narrowing;

wherein the bellows portion comprises an upper annular wall, which is oblique with respect to the vertical axis of the device, and a lower annular wall, which is oblique to the vertical axis, said walls being connected to each other, in correspondence to their outer circumferences, by a thin portion, which is substantially cylindrical; the upper annular wall widening at a continuous oblique angle relative to the vertical axis of the device from the connection mouth to the thin portion; and the lower annular wall widening at a continuous oblique angle relative to the vertical axis of the device from the annular oval shaped narrowing to the thin portion.

2. Device according to claim 1, wherein the annular narrowing presents at least one first diameter with a smaller size than a second diameter of the annular narrowing and said first diameter has a diameter that is smaller than a diameter of the cap.

3. Device according to claim 1, wherein a disinfectant substance is contained in the watertight chamber.

4. Device according to claim 1, wherein Povidone-iodine is contained in the watertight chamber.

* * * * *